US005855001A

United States Patent [19]

Doederlein et al.

[11] Patent Number: 5,855,001

[45] Date of Patent: Dec. 29, 1998

[54] TALKING TRADING CARD PLAYER SYSTEM

[75] Inventors: Dieter D. Doederlein, Mississauga; G. Dale Newman, Unionville; Anthony C. Sharp, Agincourt, all of Canada; Michael E. Lucas, Cupertino, Calif.

[73] Assignee: Micra SoundCards, Inc., Richardmond Hill, Canada

[21] Appl. No.: 519,839

[22] Filed: Aug. 25, 1995

[51] Int. Cl.[6] ..... G10L 3/00

[52] U.S. Cl. ..... 704/270; 273/237; 40/457; 40/455; 40/442

[58] Field of Search ..... 395/2, 2.1, 2.67, 395/2.79, 2.81; 381/51; 40/124.1, 152, 156, 455, 906; 446/147–152; 273/308; 364/410; 369/68

[56] References Cited

U.S. PATENT DOCUMENTS

| | | | |
|---|---|---|---|
| 3,524,272 | 8/1970 | Elwell | 40/906 |
| 3,691,312 | 9/1972 | Petersen | 179/100.2 |
| 4,159,417 | 6/1979 | Rubincam | 235/375 |
| 4,287,568 | 9/1981 | Lester | 395/425 |
| 4,607,747 | 8/1986 | Steiner | 206/232 |
| 4,648,086 | 3/1987 | Koike | 369/65 |
| 4,791,741 | 12/1988 | Kondo | 40/124.1 |
| 4,980,919 | 12/1990 | Tsai | 381/51 |
| 5,026,058 | 6/1991 | Bromley | 273/93 |
| 5,045,327 | 9/1991 | Tarlow et al. | 395/2.81 |
| 5,056,145 | 10/1991 | Yamamoto et al. | 395/2.79 |
| 5,179,517 | 1/1993 | Sarbin et al. | 364/410 |
| 5,181,744 | 1/1993 | Betheil | 283/56 |
| 5,212,368 | 5/1993 | Hara | 235/375 |
| 5,285,437 | 2/1994 | Yokota et al. | 369/64 |
| 5,325,463 | 6/1994 | Murata et al. | 395/2.75 |
| 5,359,698 | 10/1994 | Goldberg et al. | 395/2.79 |
| 5,365,686 | 11/1994 | Scott | 40/455 |
| 5,411,259 | 5/1995 | Pearson et al. | 273/93 |
| 5,480,156 | 1/1996 | Doederlein | 273/237 |
| 5,588,678 | 12/1996 | Young | 283/67 |
| 5,641,164 | 6/1997 | Doederlein | 273/237 |

FOREIGN PATENT DOCUMENTS 4207447 9/1993 Germany .

OTHER PUBLICATIONS

ISD 1012A/10106A/1020A, Single–Chip Voice Record/Playback Devices, Information Storage Devices, Inc., Feb. 1992.

*Primary Examiner*—David R. Hudspeth
*Assistant Examiner*—Michael N. Opsasnick
*Attorney, Agent, or Firm*—Lappin & Kusmer LLP

[57] ABSTRACT

A talking trading card playing system consists of a portable card player and a plurality of trading cards. Each card includes a card body having front and back surfaces, flexible sheets affixed to the front surface and to the back surface of the housing, and a voice chip for storing and generating sound patterns. The portable player comprises a power source located in the housing for supplying electrical power to the voice chip, and sound generation components. The subject trading card and player may be activated by inserting the card into the player, thereby establishing electrical contact between the card and the player.

27 Claims, 4 Drawing Sheets

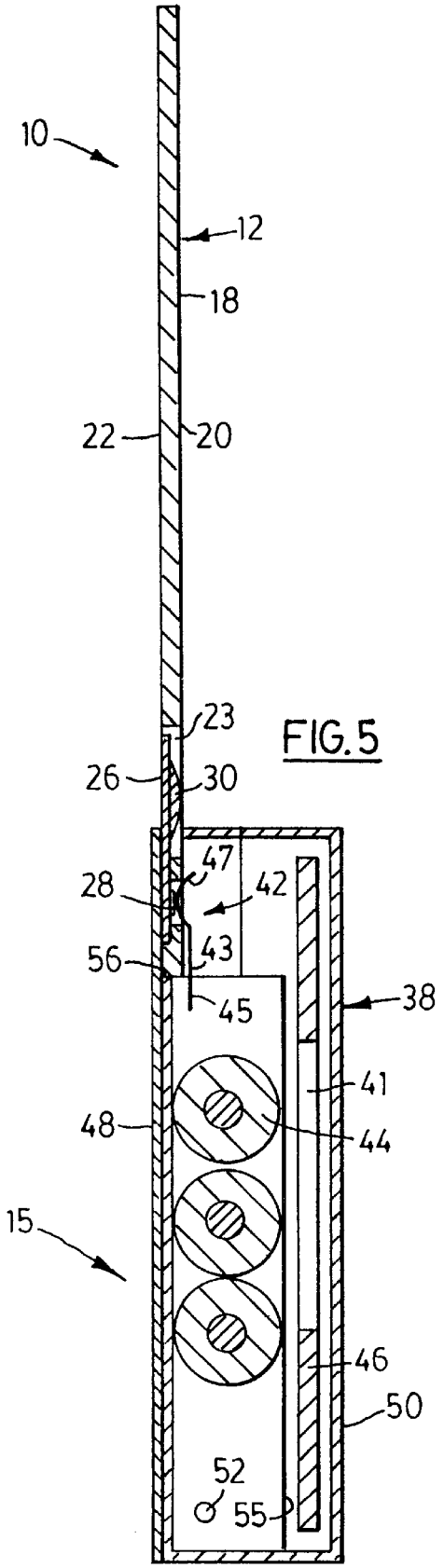
FIG.5
FIG.6
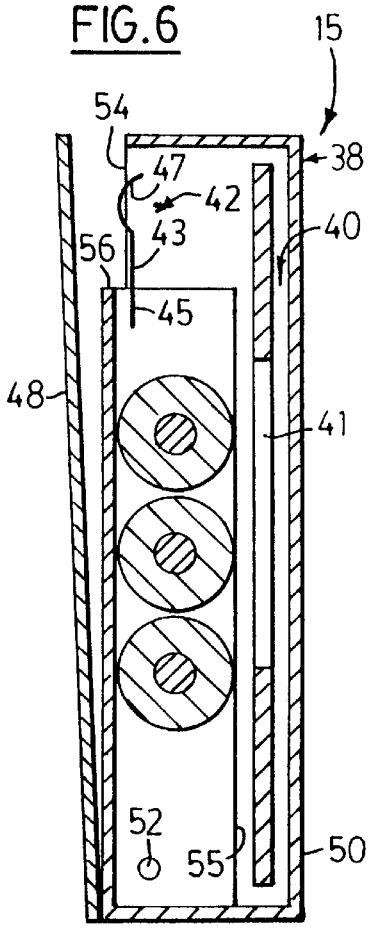

TALKING TRADING CARD PLAYER SYSTEM

BACKGROUND OF THE INVENTION

This invention relates to collectable cards, and in particular, sports trading cards such as baseball cards, hockey cards and the like.

Baseball cards and other sports trading cards have been available since the turn of the century. These cards typically display an action photograph or other image of a baseball player or other athlete on the front face, and statistics and other personal information about the player on the back face. Collecting and trading baseball cards and other sports cards is a popular hobby engaged in by both children and adults. Sports cards tend to appreciate in value over the years, with rare cards such as the 1909 Honus Wagner baseball card being valued at several hundred thousand dollars.

In recent years, collecting sports cards has increased in popularity, particularly among younger collectors. Card manufacturers have responded to this increase in popularity by introducing innovations such as holographic logos and gold-plated collector sets. However, conventional sports trading cards are passive, and the type of information provided thereon has remained relatively constant over the years. The present inventors have recognized a need and demand for sports cards which provide more information and value than that available from conventional passive sports cards.

An active trading card, which provides sounds in addition to the standard graphics and text contained on a traditional trading card, is the subject of co-pending application Ser. No. 08/433,851 filed May 2, 1995, and owned by the Assignee of the subject application. This talking trading card is self-contained, in that the speaker assembly, the replaceable battery, and the electronic data storage and processing components are all built into the card. It also has a relatively thin card profile. However, this card construction places certain constraints on the size, quality and cost of the components thereof.

There exist card reading devices which utilize scanning mechanisms for reading information from cards. In some cases, these devices are used with trading cards as part an interactive sports game. The information is typically stored in the form of bar-codes or magnetic strips mounted on a card which is scanned by a reader device for use in the relevant application.

These prior art systems have certain disadvantages. They utilize mechanical or quasi-mechanical processes for scanning data and transforming it into an electrical format, which tend to suffer from data entry error arising from mechanical imprecision. Those prior art devices which utilize physical storage methods, for example magnetic strips, sometimes experience data integrity problems resulting from wear caused by frequent use. Data integrity may also be lost through unintentional physical contact between the user and these forms of exposed data storage.

These prior art systems also tend to be bulky, expensive, and not-easily portable. Accordingly, they are not well suited to the collection of trading cards.

SUMMARY OF THE INVENTION

The present invention relates to an improved talking trading card system which utilizes a trading card containing sound data stored on an integrated circuit chip embedded within the trading card, and a separate portable card player housing batteries and a speaker.

Eliminating the need for each card to contain its own power source and speaker components reduces the cost of each card. At the same time, placing the power source in the card player allows for the use of a wider range of power sources with various storage capacities and cost levels. The subject trading cards can also achieve a thinner profile than self-contained talking cards. Furthermore, the subject portable player is capable of producing higher quality and louder sound at a lower cost, than cards containing a speaker.

The subject trading card comprises a card body of predetermined dimensions having a front surface and a back surface. Electronic storage means for storing sound pattern data is located between the front surface and the back surface of the card body. Card contact means electrically connected to the electronic storage means enables electrical contact with the subject card player.

The corresponding subject portable player comprises a pocket-sized player housing dimensioned to removably receive the card. The player housing contains sound generating means for generating sounds, power means for supplying electrical power to the processing means and to the sound generating means, and player contact means for making electrical contact with the card contact means.

The subject invention further comprises processing means for receiving sound pattern data from the storage means and sending electrical analogue signals to the sound generating means correlatable with the sound pattern data.

In a preferred embodiment, the subject trading card includes a card housing containing the electronic processing means, having flexible sheets containing graphics affixed to the front and back surfaces thereof. This card housing provides rigidity to the trading card, as well as added protection for the processing means.

The subject trading card is preferably provided with a rectangular aperture in the card housing shaped to fit a circuit board containing the electronic storage and processing means. The housing may include a support ledge near the aperture for supporting a portion of the circuit board, assisting to hold the circuit board in place. The card housing may also have a series of small circular apertures positioned to expose the card contact means located on the circuit board.

The card player of the subject invention preferably comprises a player housing having a base and a cover pivotally connected thereto, the cover being pivotal between an open and a closed position. When the player housing is in the open position, the card is removably insertable into the player. When the player housing is in the closed position, the cover makes contact with and applies pressure to the card, forcing the card contact means onto and thereby making electrical contact with the player contact means.

The card player preferably includes card stop means for stopping the card once it has been inserted a preselected distance into the player so that the card contacts register with the player contacts.

The player contact means preferably comprises a plurality of thin narrow conductive contacts having one end fixed to the battery compartment and the other end free with a curved tip, flexibly biased towards the cover and adapted to fit through the apertures of the card body to make contact with the card contact means.

BRIEF DESCRIPTION OF THE DRAWINGS

The present invention will now be described, by way of example only, with reference to the following drawings, in which:

FIG. 5 is a sectional view of the card and card player taken along lines 5—5 in FIG. 4; and FIG. 6 is a sectional view of the subject card player, with the card player cover in the open position;

DETAILED DESCRIPTION OF THE PREFERRED EMBODIMENT

Figure 1A:
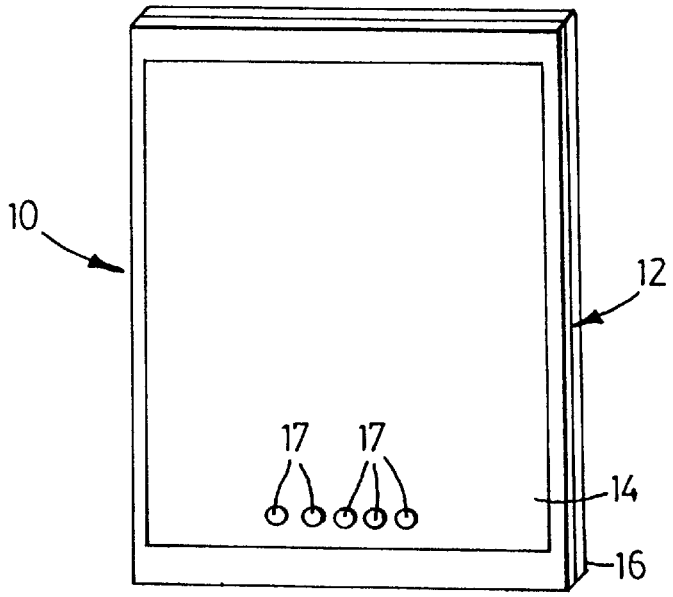
FIG. 1*a* is a perspective view of a preferred embodiment of a trading card made in accordance with the subject invention.
Figure 1B:
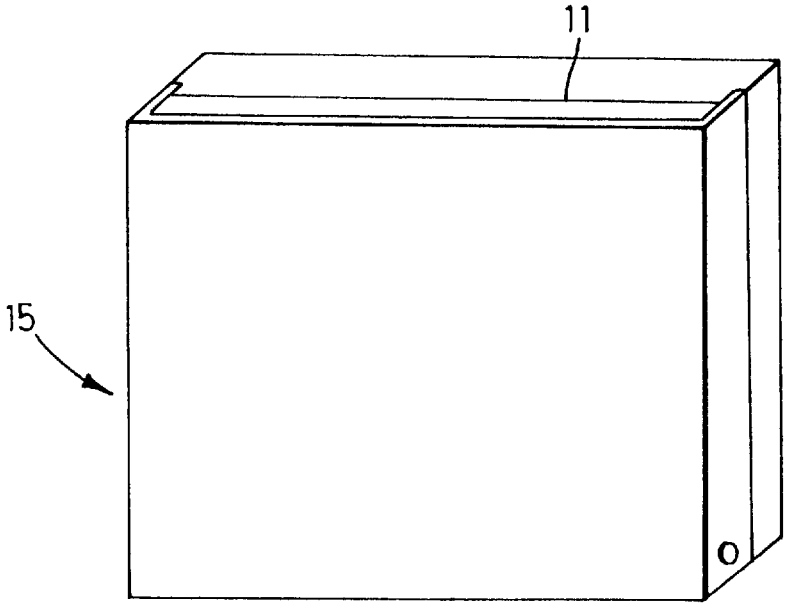
FIG. 1*b* is a perspective view of a preferred embodiment of a player made in accordance with the subject invention.

Referring to FIGS. 1*a* and 1*b*, in a preferred embodiment, the talking trading card system of the subject invention comprises a trading card 10 dimensioned to fit into slot 11 of pocket-sized card player 15.

As shown in FIG. 1*a*, trading card 10 comprises a thin rectangular card housing shown generally as 12 having thin flexible sheets 14, 16, adhesively affixed to the front and back surfaces of card housing 12. Sheets 14, 16 are preferably made from card stock, paper, or other flexible substrates suitable for printing. Typically, front sheet 14 is printed with a reproduction of a colour photograph or other image of a sports player, and back sheet 16 is printed with statistics and other personal information about the player. Front sheet 14 is provided with a row of small circular sheet apertures 17 near the bottom edge thereof.

The dimensions of card housing 12 and flexible sheets 14, 16 are preferably equal to the dimensions of conventional sports trading cards, i.e. 2.5 by 3.5 inches. The thickness of housing 12 is preferably less than 2 mm.

Figure 3:
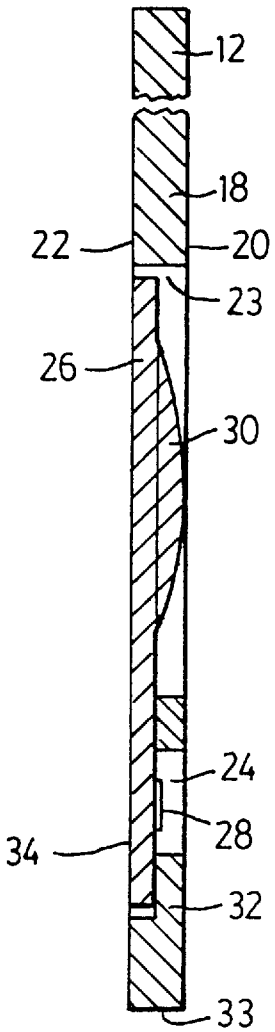
FIG. 3 is an expanded sectional view taken along lines 3—3 in FIG. 2.
Figure 2:
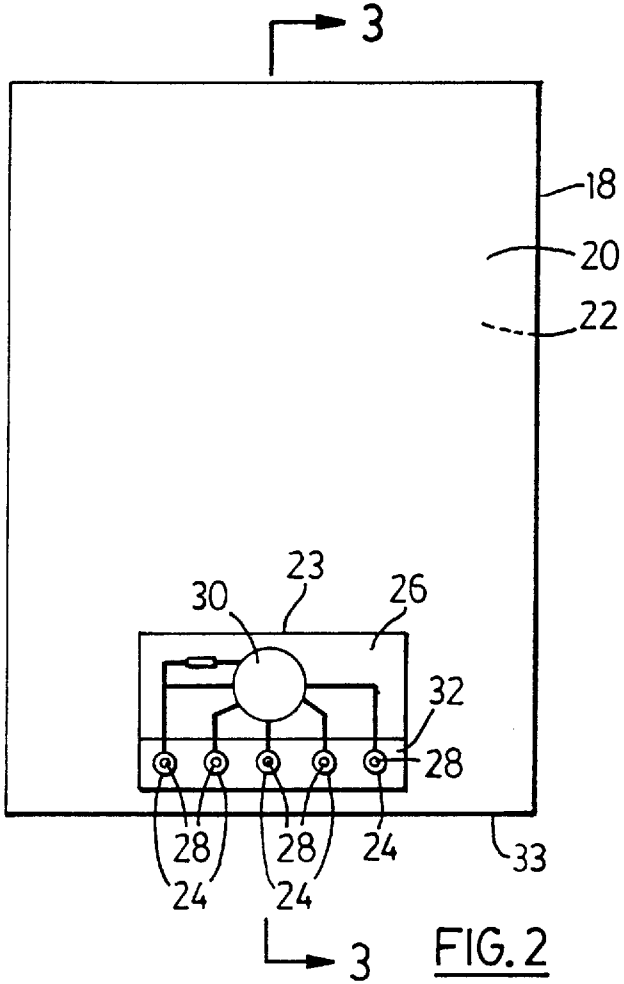
FIG. 2 is a front plan view of the subject card with the flexible sheets removed.

Referring now to FIGS. 2–3, card housing 12 comprises a flat panel 18 made of plastic, cardboard, or other light, rigid material, having flat front surface 20 and flat back surface 22. Panel 18 is provided with a large, rectangular aperture 23 sized to receive circuit board 26 containing card contacts 28 and voice chip 30.

As shown in FIG. 3, panel 18 includes support ledge 32 of reduced thickness near bottom edge 33 of panel 18 which provides support for lower portion 34 of circuit board 26 and assists in holding circuit board 26 in place. Ledge 32 is provided with a horizontal row of small circular panel apertures 24 situated below aperture 23, and spaced so as to expose card contacts 28. Sheet apertures 17 are likewise located to register with panel apertures 24 and contacts 28, when front sheet 14 is applied to card housing 12 as shown in FIG. 1.

Card contacts 28 are recessed below the top surface of card housing panel 18, and apertures 17 and 24 are relatively small, which makes it difficult for a person handling card 10 to touch card contacts 28 with his or her fingers. The protection to card contacts 28 from accidental contact by the person using card 10 provided by this structure reduces the possibility of discharging static electricity onto card contacts 28, which might damage voice chip 30.

Figure 4:
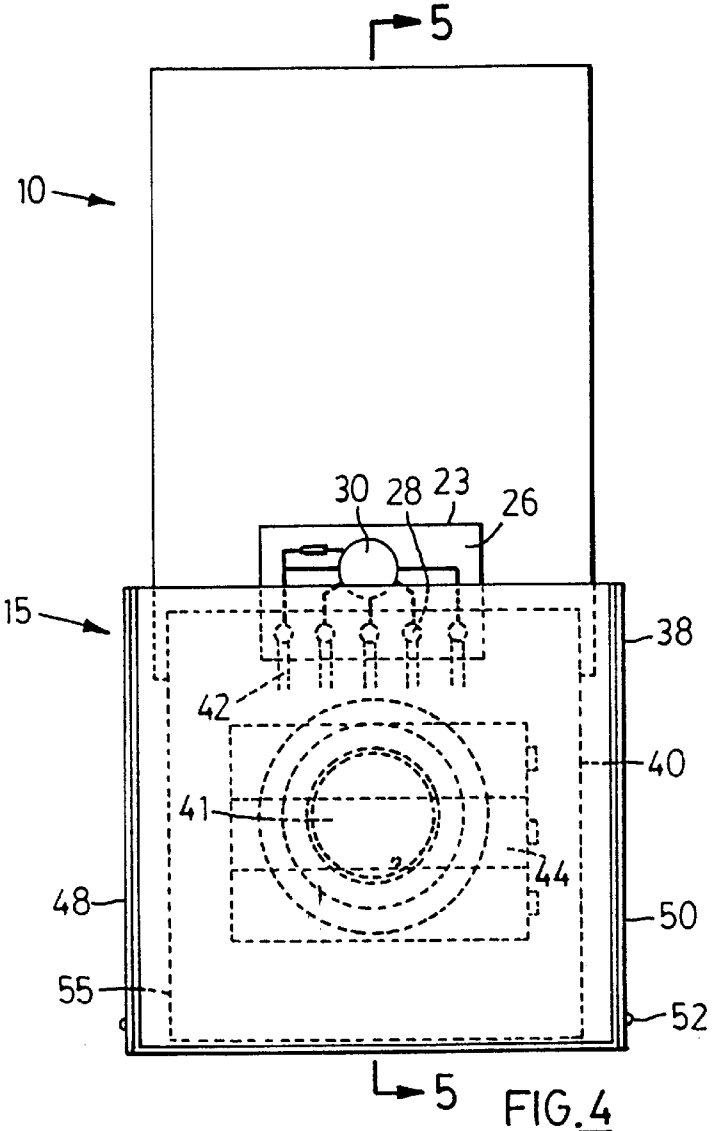
FIG. 4 is a front plan view of a preferred embodiment of a card player made in accordance with the subject invention, shown with a card physically and electrically connected therewith, and the card player cover in the closed position.

Referring now to FIGS. 4–6, in a preferred embodiment, card player 15, comprises a rectangular box-shaped housing shown generally as 38 containing speaker assembly 40, spring loaded player contacts 42 which make electrical contact with card contacts 28, and batteries 44 which provide electrical power to voice chip 30.

Player housing 38 includes cover 48 pivotally connected to base 50 by hinge 52. Cover 48 is pivotal between an open position as shown in FIG. 6 and a closed position as shown in FIG. 5. Player housing 38 includes card support platform 54, and battery compartment 55 shaped to hold batteries 44. The front edge of battery compartment 55 forms a card stop surface 56 which stops card 10 once it has been inserted far enough into player 15 such that player contacts 42 register with card contacts 28.

Player contacts 42 preferably take the form of five thin narrow and resilient metal contact strips 43, each having a fixed end 45 affixed in card stop surface 56. Contact strips 43 each extend partway along the card support platform 54, and have a free end with a curved tip 47 flexibly biased towards cover 48. Card support platform 54 is provided with recesses (not shown) shaped to fit player contact strips 43. In the closed position, shown in FIG. 5, cover 48 and card support platform 54 define thin, rectangular card insertion slot 11 (see FIG. 1*b*) shaped to accept the width and thickness of card 10.

When cover 48 is in the open position, as shown in FIG. 6, card 10 is slid into player 15 until the leading edge thereof abuts card stop surface 56, thereby registering player contacts 42 with card contacts 28. When cover 48 is moved to the closed position, as shown in FIG. 5, cover 48 applies pressure to card 10 forcing card contacts 28 onto and thereby making electrical contact with player contacts 42.

Having spring loaded player contacts 42 substantially in the form described prevents player contacts 42 and card contacts 28 from having to slide against each other, which would eventually cause wear.

Figure 7:
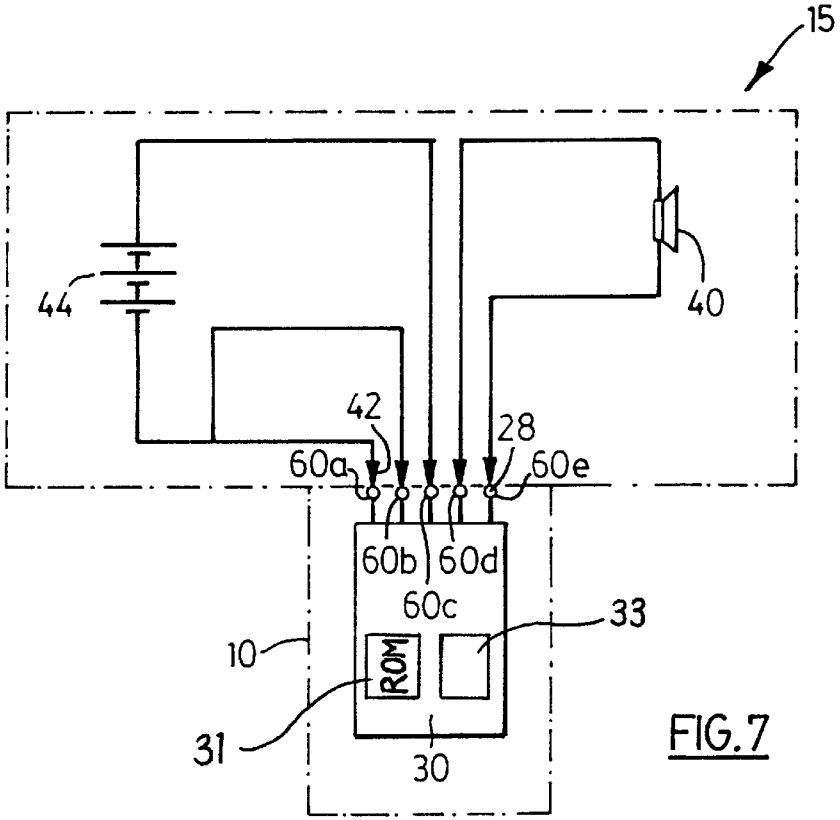
FIG. 7 is a simplified circuit diagram of the electrical components of the preferred embodiments of the card and card player when electrically connected.

Referring now to FIG. 7, voice chip 30 in card 10 is electrically connected to speaker assembly 40 and batteries 44 in player 15 by card contacts 28 and player contacts 42. Contact node 60*a* electrically connects the negative terminal of batteries 44 to voice chip 30 to provide input voltage. Contact node 60*b* electrically connects the negative terminal of batteries 44 to voice chip 30 and is used to activate voice chip 30, thereby initiating the playback of recorded sound. Contact node 60*c* electrically connects the positive terminal of batteries 44 to voice chip 30. Contact node 60*d* electrically connects the speaker assembly 40 to the electrical analogue output terminal of voice chip 30. Contact node 60*e* electrically connects voice chip 30 to speaker assembly 40, completing the circuit. Batteries 44 maintain voice chip 30 at a 4.5V input voltage.

Voice chip 30 may be a single chip integrated circuit utilizing VLSI technology, comprising a 360K ROM 31 for voice data storage, adapted to be powered by a power supply in the range of 2.4 volts to 5.0 volts. Voice chip 30 preferably includes processing means 33 capable of providing voice or other sound output of approximately 10–90 seconds long at a 5K sampling rate. Speaker assembly 40 preferably comprises a piezo-electric speaker 41 mounted in sounding board 46 as shown in co-pending application Ser. No. 08/433,851. Batteries 44 are preferably three 1.5 volt AA batteries in series supplying 4.5 volts of power.

Voice chip 30 generates a preselected output signal which recreates the sports player's voice or other recognizable voice or sound recording related to the person or event being featured on card 10. Voice chip 30 is typically programmed by the voice chip manufacturer, using a sound recording stored on an audio tape or the like. This sound recording is digitized by the manufacturer, using a sampling rate of 5K or the like, and stored in the voice chip's ROM storage.

In operation, the voice chip 30 is activated by establishing electrical contact between player contacts 42 and card contacts 28, which completes the circuit shown in FIG. 7, thereby drawing current from batteries 44 to voice chip 30. In the preferred embodiment, electrical contact between player contacts 42 and card contacts 28 at contact node 60*b* is made a fraction of a second after the other electrical contacts have been established, as voice chip 30 requires the initiation signal to be sent after it has been energized. It should be noted, however, that some voice chips do not require the use of a separate, delayed initiation signal, in which case contact node 60*b* would not be required. The output signal of voice chip 30 through contact node 60*d* is an analogue signal capable of driving speaker 41, thereby generating sounds. When the output sound signal is completed, voice chip 30 automatically shuts off.

The card player 15 of the subject invention may be constructed in an inexpensive fashion to be thin and light and easily carried in the user's pocket, thereby offering true portability.

While the subject invention has been illustrated and described as comprising a card containing an integrated circuit chip with both processing means 33 and data storage means 31, the invention may comprise a card containing a chip with only data storage capability, with the player containing a chip with processing capabilities.

While the subject invention has been illustrated and described as comprising a player with a cover rotatably connected to a base, the invention may comprise a player without a cover in which the card is directed into a fixed opening in the player to establish electrical contact between the card and the player.

While the subject invention has been illustrated and described as comprising a card having a card housing comprising a flat housing panel preferably made of plastic, cardboard or other suitable material, a less expensive form of the card may forego the use of a housing panel and may simply consist of the front flexible sheet and the back flexible sheet affixed to each other and encapsulating the circuit board.

While the subject invention has been illustrated and described with respect to sports trading cards, it is equally applicable to other types of cards, such as cards pertaining to entertainment, politics, history, religion, nature and other applications.

Thus, while what is shown and described herein constitutes a preferred embodiment of the subject invention, it should be understood that various changes can be made without departing from the subject invention, the scope of which is defined in the appended claims.

We claim:

1. A portable pocket-sized trading card playing system capable of generating sounds, comprising a card player and a plurality of cards, wherein each card of the plurality of cards comprises a card body of predetermined dimensions and having a bottom edge, a front surface and a back surface, a front and back surfaces permanently displaying graphics and text of interest to card traders, a voice chip located between the front surface and the back surface of the card body having permanently stored thereon digital sound pattern data representative of preselected patterns of sound correlated with the graphics and text, the voice chip including processing means for receiving sound pattern data from the voice chip and generating electrical analogue signals correlatable therewith, and card contact means located near the bottom edge and electrically connected to the processing means for enabling electrical contact with the card player, wherein the card player comprises a player housing dimensioned to removably receive the bottom edge of the card, the player housing containing sound generating means for generating sounds, power means for supplying electrical power to the processing means and to the sound generating means, and player contact means for making electrical contact with the card contact means.

2. The system defined in claim 1, wherein the card body comprises a card housing having a front housing surface and a back housing surface, a flexible front sheet affixed to the front housing surface and a flexible back sheet affixed to the back housing surface, the flexible sheets displaying said graphics and text, wherein the voice chip is housed in the card housing.

3. The system defined in claim 2, wherein the voice chip and the card contact means are mounted on a circuit board housed in the card housing.

4. The system defined in claim 3, wherein the card contact means comprises a plurality of card contacts located on the circuit board.

5. The system defined in claim 4, wherein the card housing comprises a thin panel having a rectangular aperture therein shaped to fit the circuit board.

6. The system defined in claim 5 wherein the panel comprises a support ledge of reduced thickness adjacent the rectangular aperture for supporting a portion of the circuit board.

7. The system defined in claim 2, wherein the card contact means comprises a plurality of card contacts located on the circuit board, and the card housing is provided with a series of spaced small housing apertures located so as to expose the card contacts, wherein each of the card contacts is recessed within one of the small housing apertures, and wherein the diameter of each aperture and the depth of the recessing of the card contacts are selected to prevent a user's fingers from contacting the card contacts.

8. The system defined in claim 7, wherein the front sheet is provided with a series of spaced small circular sheet apertures which register with the housing apertures when the front sheet is applied to the housing.

9. The system defined in claim 8, wherein the housing apertures are located in the support ledge.

10. The system defined in claim 1, wherein the player housing comprises a base and a cover pivotally connected thereto, the cover being pivotal between an open position and a closed position.

11. The system defined in claim 10, wherein the card is removably insertable into the player when the cover is in the open position, and wherein the cover makes contact with and applies pressure to the card, when the cover is pivoted to the closed position, forcing the card contact means onto and thereby making electrical contact with the player contact means.

12. The system defined in claim 11, wherein the power means comprises battery holding means for holding at least one battery.

13. The system defined in claim 12, wherein the battery holding means comprises a battery compartment.

14. The system defined in claim 10, wherein the player housing comprises a card support surface parallel to and spaced from the cover when the cover is in the closed position so as to define a card insertion slot.

15. The system in claim 14, wherein the player housing comprises card stop means for stopping the card once it has been inserted a pre-selected distance into the player, so that the card contacts register with the player contact means, and most of the front surface and the back surface of the card remains outside of the player for viewing by card traders.

16. The system defined in claim 15, wherein the cover is rectangular and U-shaped, in cross-section.

17. The system defined in claim 16, wherein the player contact means comprises a plurality of thin narrow conductive player contacts having one end fixed and extending from the card stop means, and having a free end with a curved tip flexibly biased towards the cover and shaped to fit through the apertures of the card body to make contact with the card contact means.

18. A trading card for use with a portable card player having a player housing dimensioned to removably receive the card and containing sound generating means for generating sound, power means for supplying electrical power to the sound generating means and to the card, and player contact means for making electrical contact with the card, the card comprising a card body of predetermined dimensions and having a bottom edge, a front surface and a back surface, the front surface and the back surface displaying graphics and text of interest to card traders, electronic processing means sandwiched therebetween having permanently stored thereon digital sound pattern data representative of preselected patterns of sound correlated with the graphics and text and generating electrical signals correlatable with the sound pattern data to the player, and card contact means electrically connected to the processing means for enabling electrical contact with the player contact means, wherein the card contact means comprises a plurality of card contacts recessed within apertures in the front surface or the back surface of the card near the bottom edge thereof.

19. The trading card defined in claim 18, wherein the electronic processing means comprises storage means for storing the sound pattern data, and output means for outputting electrical analogue signals to the player correlatable with the sound pattern data.

20. The trading card defined in claim 19, wherein the trading card comprises a card housing having a front housing surface and a back housing surface, a flexible front sheet affixed to the front housing surface and a flexible back sheet affixed to the back housing surface, the flexible sheets displaying said graphics and text, wherein the electronic processing means is housed in the card housing.

21. The trading card defined in claim 20, wherein the storage means, the processing means and the card contact means are located on a circuit board.

22. The trading card defined in claim 21, wherein the card housing comprises a thin panel having a rectangular aperture therein shaped to fit the circuit board.

23. A portable card player for use with a trading card having electronically stored therein sound pattern data representative of preselected patterns of sound and having card contact means for enabling electrical contact with the player, the player comprising:

(a) a player housing dimensioned to removably receive the card;

(b) sound generating means located in the player housing for generating sounds;

(c) power means located in the player housing for supplying electrical power to the trading card and to the sound generation means;

(d) player contact means located in the player housing for making electrical contact with the card contact means;

(e) wherein the player housing comprises a base and a cover pivotally connected thereto, the cover being pivotal between an open position and a closed position; and (f) wherein the player housing comprises a card support surface parallel to and spaced from the cover when the cover is in the closed position so as to define a card insertion slot, and wherein the player housing comprises card stop means for stopping the card once it has been inserted a pre-selected distance into the player so that the card contact means registers with the player contact means and so that most of the front surface and the back surface of the card remains outside of the player for viewing by card traders.

24. The trading card player defined in claim 23, wherein the power means comprises a battery holding means for holding at least one battery.

25. The trading card player defined in claim 24, wherein the player contact means comprises a plurality of thin narrow conductive player contacts having one end fixed and extending from the card stop means, and having a free end with a curved tip flexibly biased towards the cover and shaped to fit through the apertures of the card body to make contact with the card contact means.

26. The system defined in claim 2, wherein the graphics and text displayed on the flexible front sheet is correlated to the graphics and text displayed on the flexible back sheet.

27. The system defined in claim 10, wherein the base comprises an enclosed compartment dimensional for housing the power means.

* * * * *

UNITED STATES PATENT AND TRADEMARK OFFICE

CERTIFICATE OF CORRECTION

PATENT NO. : 5,855,001

DATED : December 29, 1998

INVENTOR(S) : Doederlein et al.

It is certified that error appears in the above-identified patent and that said Letters Patent is hereby corrected as shown below:

On the title page,

[73] Assignee: Micra SoundCards Inc., Richmond Hill, Ontario, Canada

Signed and Sealed this

First Day of June, 1999

*Attest:*

*Attesting Officer*

Q. TODD DICKINSON

*Acting Commissioner of Patents and Trademarks*

UNITED STATES PATENT AND TRADEMARK OFFICE

CERTIFICATE OF CORRECTION

PATENT NO. : 5,855,001
DATED : December 29, 1998
INVENTOR(S) : Doederlein et al.

It is certified that error appears in the above-identified patent and that said Letters Patent is hereby corrected as shown below:

1. A portable pocket-sized trading card playing system capable of generating sounds, comprising a card player and a plurality of cards, wherein each card of the plurality of cards comprises:

A. a card body of predetermined dimensions and having a bottom edge, a front surface and a back surface, said front and back surfaces permanently displaying graphics and text of interest to card traders, B. a voice chip located between the front surface and the back surface of the card body having permanently stored thereon digital sound pattern data representative of preselected patterns of sound correlated with the graphics and text, the voice chip including processing means for processing the sound pattern data and generating analog electrical signals for generating said preselected pattern of sound, and C. card contact means located near the bottom edge and electrically connected to the voice chip for enabling electrical contact with the card player; and wherein the card player comprises a player housing dimensioned to removably receive the bottom edge of the card, containing:

A. player contact means for making electrical contact with the card contact means to enable transfer of said electrical signals to said housing, B. sound generating means including a transducer for generating sounds in response to said electrical signals, C. power means for supplying electrical power to the voice chip and to the sound generating means.

UNITED STATES PATENT AND TRADEMARK OFFICE

CERTIFICATE OF CORRECTION

PATENT NO. : 5,855,001
DATED : December 29, 1998
INVENTOR(S) : Doederlein et al.

It is certified that error appears in the above-identified patent and that said Letters Patent is hereby corrected as shown below:

19. A trading card for use with a portable card player having a player housing dimensioned to removably receive the card and containing sound generating means including a transducer for generating sound in response to applied analog electrical signals, power means for supplying electrical power to the sound generating means and to the card, and player contact means for making electrical contact with the card to receive said electrical signals from said card and apply said received electrical signals to said transducer, the card comprising:

A. a card body of predetermined dimensions and having a bottom edge, a front surface and a back surface, the front surface and the back surface displaying graphics and text of interest to card traders, B. a voice chip positioned between the front and back surfaces having permanently stored thereon sound pattern data representative of preselected patterns of sound correlated with the graphics and text and including means for generating analog electrical signals for producing the preselected patterns of sound at the player, and C. card contact means electrically connected to the processing means for enabling electrical contact with the player contact means to transfer said generated electrical signals to said player contact means.

20. The trading card defined in claim 19, wherein the voice chip comprises storage means for storing the sound pattern data, and output means for outputting analog electrical signals to the player correlatable with the sound pattern data.

21. The trading card defined in claim 20, wherein the trading card comprises a card housing having a front housing surface and a back housing surface, a flexible front sheet affixed to the front housing surface -and a flexible back sheet affixed to the back housing surface, wherein the voice chip is housed in the card housing.

UNITED STATES PATENT AND TRADEMARK OFFICE

CERTIFICATE OF CORRECTION

PATENT NO. : 5,855,001
DATED : December 29, 1998
INVENTOR(S) : Doederlein et al.

It is certified that error appears in the above-identified patent and that said Letters Patent is hereby corrected as shown below:

22. The trading card defined in claim 21, wherein the voice chip and the card contact means are located on a circuit board.

24. A portable card player for use with a trading card having electronically stored therein sound pattern data representative of preselected patterns of sound and means for generating analog electrical signals representative thereof, and having card contact means for enabling electrical contact with the player, the player comprising:

A. a player housing dimensioned to removably receive the card;

B. player contact means located in the player housing for making electrical contact with the card contact means and for receiving said analog electrical signals therefrom;

C. sound generating means located in the player housing, said sound generating means including a transducer, for generating sounds in response to said received analog signals;

D. power means located in the player housing for supplying electrical power to the trading card and to the sound generation means.

Signed and Sealed this

Fourth Day of September, 2001

Nicholas P. Godici

*Attest:*

*Attesting Officer*

NICHOLAS P. GODICI
*Acting Director of the United States Patent and Trademark Office*